US008021501B2

(12) United States Patent
Roth

(10) Patent No.: US 8,021,501 B2
(45) Date of Patent: Sep. 20, 2011

(54) SINGLE POINT INCREMENTAL FORMING OF METALLIC MATERIALS USING APPLIED DIRECT CURRENT

(75) Inventor: John Roth, Mckean, PA (US)

(73) Assignee: The Penn State Research Foundation, University Park, PA (US)

( * ) Notice: Subject to any disclaimer, the term of this patent is extended or adjusted under 35 U.S.C. 154(b) by 338 days.

(21) Appl. No.: 12/194,355

(22) Filed: Aug. 19, 2008

(65) Prior Publication Data

US 2009/0044590 A1 Feb. 19, 2009

Related U.S. Application Data

(63) Continuation-in-part of application No. 12/117,970, filed on May 9, 2008.

(60) Provisional application No. 60/916,957, filed on May 9, 2007.

(51) Int. Cl.
*B21D 37/16* (2006.01)

(52) U.S. Cl. ..... 148/566; 72/342.96

(58) Field of Classification Search ..... 148/566; 72/342.96

See application file for complete search history.

(56) References Cited

U.S. PATENT DOCUMENTS 7,302,821 B1 * 12/2007 Dariavach et al. ..... 72/342.96
7,516,640 B2 * 4/2009 Golovashchenko et al. ..... 72/342.96

OTHER PUBLICATIONS

Mao et al, Study on instability of the point bolster sheet metal dieless forming, Journal of Materials Processing Technology, 176 (2006) pp. 13-18.*
Amir Khalilollahi et al.; Multi-Field Fe Modeling of Resistive Heating in a 6061-T6511; Aluminum Specimen; Proceedings of IMECE2006-15677; ASME International Mechanical Engineering Congress and Exhibition; pp. 1-7; Nov. 2006.
Russell L. Warley et al.; Axial Temperature Profile in a Cylindrical Tensile Bar Carrying a Large Electric Current During a Tensile Test; Proceedings of IMECE2006-14927; pp. 1-9; Nov. 2006.
Carl Ross et al.; The Effects of DC Current on the Tensile Properties of Metals; Proceedings of IMECE2005-81072; pp. 1-10; Nov. 2005.
Joseph S. Andrawes et al.; Effects of DC Current on the Stress-Strain Curve and Hardness of 6061 T6511 Aluminum; Proceedings of IMECE2004-61829; ASME International Mechanical Engineering Congress; pp. 1-10; Nov. 2004.

(Continued)

*Primary Examiner* — Roy King
*Assistant Examiner* — Jie Yang
(74) *Attorney, Agent, or Firm* — Gifford, Krass, Sprinkle, Anderson & Citkowski, P.C.

(57) ABSTRACT

A method for forming a sheet metal component using an electric current passing through the component is provided. The method can include providing a single point incremental forming, the machine operable to perform a plurality of single point incremental deformations on the sheet metal component and also apply an electric direct current to the sheet a metal component during at least part of the forming. The direct current can be applied before or after the forming has started and/or be terminated before or after the forming has stopped and can reduce the magnitude of force required to produce a given amount of deformation, increase the amount of deformation exhibited before failure and/or reduce any springback typically exhibited by the sheet metal component.

17 Claims, 10 Drawing Sheets

OTHER PUBLICATIONS

Carl D. Ross et al.; Effect of DC Current on the Formability of 6AL 4V Titanium; Proceedings of MSEC2006-21028; ASME International Conference on Manufacturing Science and Engineering; pp. 1-11; Oct. 2006.

Thomas J. Kronenberger et al; Compressive Superplastic Behavior of 6AI-4V Titanium Caused by an Applied DC Current; Proceedings of IMECE2006-14998; International Mechanical Engineering Congress and Exposition; p. 1-8; Nov. 2006.

Timothy A. Perkins et al.; The Reduction of Deformation Energy and Increase Workabiltiy of Metals Through an Applied Electric Current; Proceedings of IMECE2005-81060; pp. 1-10; Nov. 2005.

* cited by examiner

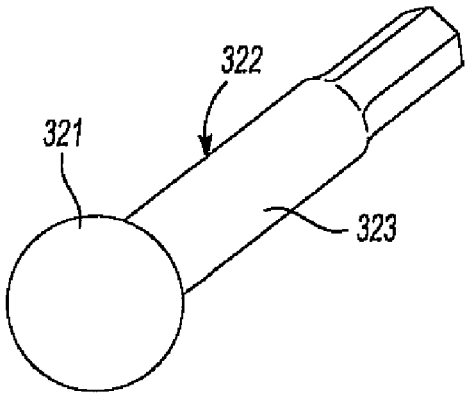
Fig-19
Fig-20A
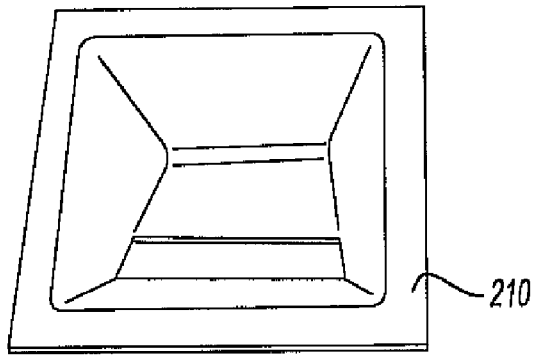
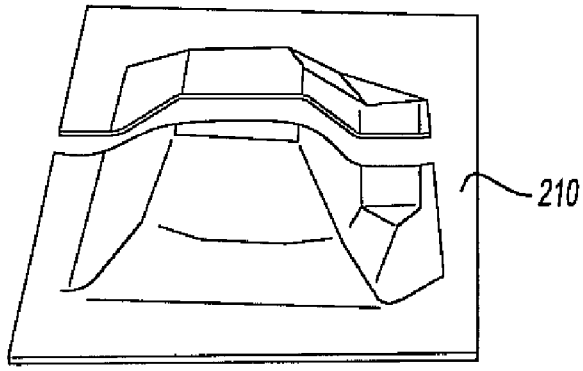
Fig-20B
Fig-21A
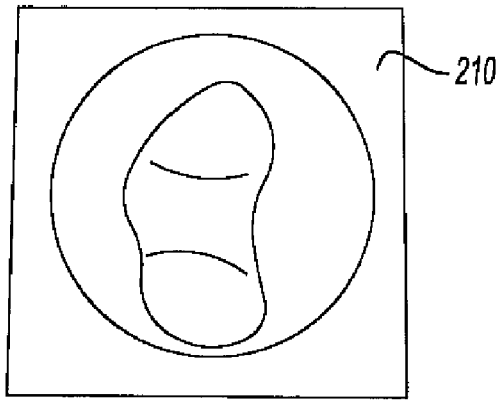
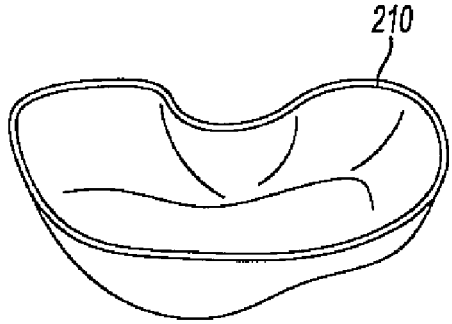
Fig-21B

SINGLE POINT INCREMENTAL FORMING OF METALLIC MATERIALS USING APPLIED DIRECT CURRENT

CROSS-REFERENCE TO RELATED APPLICATIONS

This application is a continuation-in-part of U.S. patent application Ser. No. 12/117,970 filed May 9, 2008, which claims priority of U.S. Provisional Patent Application Ser. No. 60/916,957 filed May 9, 2007, both of which are incorporated herein by reference.

FIELD OF THE INVENTION

The present invention is related to the deformation of metallic materials, and more particularly, related to the deformation of metallic materials while passing an electric current therethrough.

BACKGROUND OF THE INVENTION

During forming of metals using various bulk deformation processes, the magnitude of force required to perform deformation is a significant factor in terms of the manufacturing of parts. Generally, as the force necessary to deform a given material increases, larger equipment must be utilized, stronger tools and dies are required, tool and die wear increase, and more energy is consumed in the process. All of these factors increase the manufacturing cost of a given component. Therefore, any method or apparatus that would decrease the force required for deformation and/or increase the amount of deformation that can be achieved without fracture would have a significant impact on many manufacturing processes.

Presently, deformation forces are reduced and elongation is increased by working metals at elevated temperatures. However, significant drawbacks to deforming materials at elevated temperatures exist, such as increased tool and die adhesion, decreased die strength, decreased lubricant effectiveness, consumption of materials for heating (which raises energy cost) and the need for additional equipment to be purchased.

One possible method of deforming metallic materials without using such elevated temperatures is to apply an electric current to the workpiece during deformation. In 1969, Troitskii found that electric current pulses reduce the flow stress in metal (Troitskii, O. A., 1969, zhurnal eksperimental'noi teoreticheskoi kiziki/akademi'i'a nauk sssr—pis'ma v zhurnal. eksperimental' i teoretiheskoi fiziki, 10, pp. 18). In addition, work by Xu et al. has shown that continuous current flow can increase the recrystallization rate and grain size in certain materials (Xu, Z. S., Z. H. Lai, Y. X. Chen, 1988, "Effect of Electric Current on the Recrystallization Behavior of Cold Worked Alpha-Ti", Scripta Metallurgica, 22, pp. 187-190). Similarly, works by Chen et al. have linked electrical flow to the formation and growth of intermetallic compounds (Chen, S. W., C. M. Chen, W. C. Liu, Journal Electron Materials, 27, 1998, pp. 1193; Chen, S. W., C. M. Chen, W. C. Liu, Journal Electron Materials, 28, 1999, pp. 902).

Using pulses of electrical current instead of continuous flow, Conrad reported in several publications that very short-duration high-density electrical pulses affect the plasticity and phase transformations of metals and ceramics (Conrad, H., 2000, "Electroplasticity in Metals and Ceramics", Mat. Sci. & Engr., A287, pp. 276-287; Conrad, H., 2000, "Effects of Electric Current on Solid State Phase Transformations in Metals", Mat. Sci. & Engr. A287, pp. 227-237; Conrad, H., 2002, "Thermally Activated Plastic Flow of Metals and Ceramics with an Electric Field or Current", Mat. Sci. & Engr. A322, pp. 100-107). More recently, Andrawes et al. has shown that high levels of DC current flow can significantly alter the stress-strain behavior of 6061 aluminum (Andrawes, J. S., Kronenberger, T. J., Roth, J. T., and Warley, R. L., "Effects of DC current on the mechanical behavior of AlMgI-SiCu," *A Taylor & Francis Journal: Materials and Manufacturing Processes*, Vol. 22, No. 1, pp. 91-101, 2007). Complementing this work, Heigel et al. reports the effects of DC current flow on 6061 aluminum at a microstructural level and showed that the electrical effects could not be explained by microstructure changes alone (Heigel, J. C., Andrawes, J. S., Roth, J. T., Hoque, M. E., and Ford, R. M., "Viability of electrically treating 6061 T6511 aluminum for use in manufacturing processes," Trans of N Amer Mfg Research Inst, NAMRI/SME, V 33, pp. 145-152).

The effects of DC current on the tensile mechanical properties of a variety of metals have been investigated by Ross et al. and Perkins et al. (Ross, C. D., Irvin, D. B., and Roth, J. T., "Manufacturing aspects relating to the effects of DC current on the tensile properties of metals," *Transactions of the American Society of Mechanical Engineers, Journal of Engineering Materials and Technology*, Vol. 29, pp. 342-347, 2007; Perkins, T. A., Kronenberger, T. J., and Roth, J. T., "Metallic forging using electrical flow as an alternative to warm/hot working," *Transactions of the American Society of Mechanical Engineers, Journal of Manufacturing Science and Engineering*, vol. 129, issue 1, pp. 84-94, 2007). The work by Perkins et al. investigated the effects of currents on metals undergoing an upsetting process. Both of these previous studies included initial investigations concerning the effect of an applied electrical current on the mechanical behavior of numerous materials including alloys of copper, aluminum, iron and titanium. These publications have provided a strong indication that an electrical current, applied during deformation, lowers the force and energy required to perform bulk deformations, as well as improves the workable range of metallic materials. Recently, work by Ross et al. studied the electrical effects on 6Al-4V titanium during both compression and tension test (Ross, C. D., Kronenberger, T. J., and Roth, J. T., "Effect of DC Current on the Formability of 6AL-4V Titanium," 2006 *American Society of Mechanical Engineers—International Manufacturing Science & Engineering Conference*, MSEC 2006-21028, 11 pp., 2006).

Electrical current is the flow of electrons through a material. The electrical current meets resistance at the many defects found within materials, such as: cracks, voids, grain boundaries, dislocations, stacking faults and impurity atoms. This resistance, termed "electrical resistance", is widely known and extensively measured. The greater the spacing that exists between defects, the less resistance there is to optimal electron motion. Conversely, the less spacing between these defects, the greater the electrical resistance of the material.

During loading, material deformation occurs by the movement of dislocations within the material. Dislocations are line defects which can be formed during solidification, plastic deformation, or be present due to the presence of impurity atoms or grain boundaries. Dislocation motion is the motion of these line defects through the material's lattice structure causing plastic deformation.

Dislocations meet resistance at many of the same places as electrical current, such as: cracks, voids, grain boundaries, dislocations, stacking faults and impurity atoms. Under an applied load, dislocations normally move past these resistance areas through one of three mechanisms: cross-slip, bowing or climbing. As dislocation motion is deterred due to localized points of resistance, the material requires more force to continue additional deformation. Therefore, if dislocation motion can be aided through the material, less force is required for subsequent deformation. Theoretically, this will also cause the material's ductility to be subsequently increased.

SUMMARY OF THE INVENTION

A method for forming a sheet metal component using an electric current passing through the component is provided. The method can include providing single point incremental forming, the machine operable to perform a plurality of single point incremental deformations on the sheet metal component and also apply an electric direct current to the sheet metal component during at least part of the forming process. The direct current can be applied before or after the forming has started and/or be terminated before or after the forming has stopped and can reduce the magnitude of force required to produce a given amount of deformation, increase the amount of deformation exhibited before failure and/or reduce any springback typically exhibited by the sheet metal component. The electricity may be applied during cold, warm or hot forming operations.

BRIEF DESCRIPTION OF THE FIGURES

FIG. 19 is an illustration of an arcuate tipped tool that can be used to single point incrementally deform a sheet metal component;

FIG. 20A is an illustration of a top perspective view of a sheet metal component after being deformed by an embodiment of the present invention;

FIG. 20B is an illustration of a bottom perspective view of the sheet metal component shown in FIG. 20A;

FIG. 21A is an illustration of a top view of a sheet metal component after being deformed by an embodiment of the present invention; and FIG. 21B is an illustration of a top perspective view of a portion of the sheet metal component shown in FIG. 21A.

DETAILED DESCRIPTION OF THE PREFERRED EMBODIMENTS

Not being bound by theory, it is proposed and postulated that electron wind provided by an electric current assists dislocation motion by applying a force on the dislocations. This force helps dislocations move easily, thereby requiring less mechanical force to continue their motion. Specifically, this occurs when dislocations meet physical impediments at the different resistance areas and locations.

It is also postulated that, as electrons scatter off different resistant sources, for example the same resistance areas for dislocation motion, the local stress and energy field increases. This occurs since, as electrons strike the areas with a given velocity, there is an increase in the amount of kinetic energy around the resistance area due to transference from the electron as its scatters. Therefore, dislocations can move through the areas of resistance with increased local energy fields with less resistance. Since these areas are at a higher potential, less energy is required for a dislocation to move therethrough. In addition, the energy required to break atomic bonds as dislocations move through the lattice structure decreases.

Figure 17:
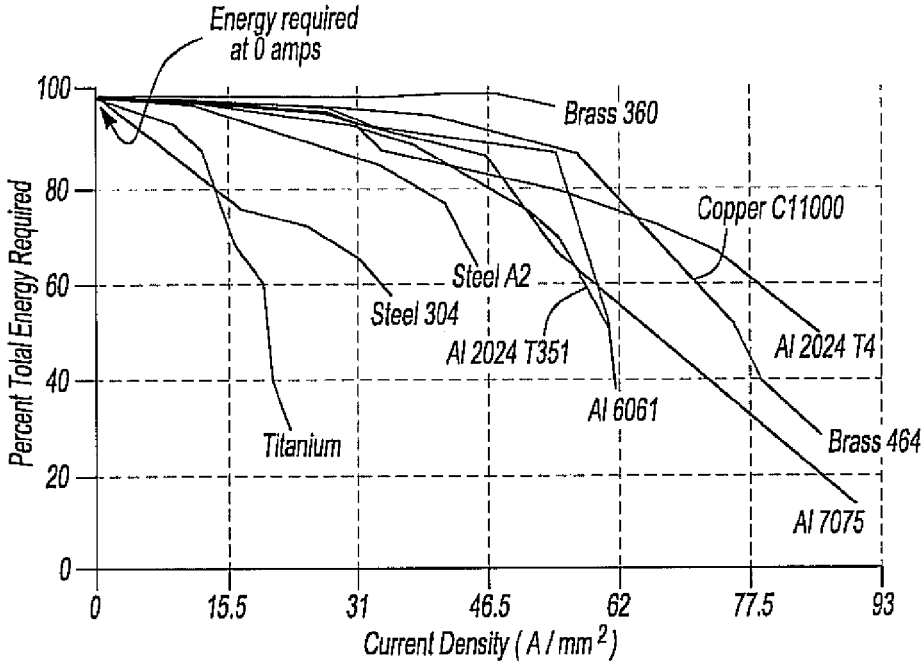
FIG. 17 is a graph of the percentage change in energy required for deformation of an alloy as a function of applied current density to the material.

Overall, it is postulated that the effects of current passing through a metallic material should result in a net reduction in the energy required to deform the material while simultaneously increasing the overall workability of the material by substantially enhancing its ductility. Such a postulation is supported by FIG. 17 where the percentage of total energy as a function of applied current density, with respect to a baseline test, is shown. Ideally, the mechanical energy per volume required for deformation is the area under the stress-strain curve. This energy was calculated for the curves of each material using numerical integration. Since some specimens fractured prior to completing the test, the curves were integrated to a strain slightly below the strain where the earliest fracture event occurred for any of the materials tested, 0.2 mm/mm. The other energy accounted for in the system is the electrical energy expended during the deformation. This energy is calculated using the relationship:

$$\text{Energy} = \frac{I^2 \cdot \rho \cdot h \cdot t}{A_c}$$

where I is current, ρ is resistivity, h is height, t is test duration and $A_c$ is cross-sectional area. The total energy expended to deform the specimen is found by summing the mechanical and electrical energies. As shown, a small addition of electrical energy can greatly reduce the total energy required to deform the part. Moreover, as the density of the electrical energy increases, the total energy needed to deform the part reduces immensely.

The present invention discloses a method for forming a sheet metal component using a single point incremental forming (SPIF) machine that also provides a source of electrical current to the component during the deformation. The method passes an electrical current through the sheet metal component during at least part of the forming operation and can control the work hardening of the sheet metal component, reduce the force required to obtain a given amount of deformation and/or reduce the amount of springback typically exhibited by the component. As such, the present invention has utility as a manufacturing process. For the purposes of the present invention, the term "work hardening" is defined as the strengthening of a component, specimen, etc., by increasing its dislocation density and such type of strengthening is typically performed by cold forming the component, specimen, etc. The term "metal" and "metallic" are used interchangeably and deemed equivalent and include materials known as metals, alloys, intermetallics, metal matrix composites and the like, and the term "spring back" is defined as the amount of elastic recovery exhibited by a component during and/or after being subjected to a forming operation.

The method can include forming a piece of sheet metal with a plurality of single point incremental deformations by an arcuate tipped tool which is fixed, freely rotating, or undergoing forced rotation while the electrical direct current is passing through the piece of sheet metal at least part of the time it is being formed. The plurality of single point incremental deformations can be afforded by a computer numerical controlled machine that is operable to move an arcuate tipped tool a predetermined distance in a predetermined direction. In the alternative, a support structure provided to rigidly hold at least part of the sheet metal component can move the sheet metal component a predetermined distance in a predetermined direction. In any event, the arcuate tipped tool comes into contact with and pushes against the sheet metal component to produce a single point incremental deformation, with the plurality of single point incremental deformations producing a desired shape out of the component. In some instances, the electrical direct current is applied to the component before or after the forming of the component has been initiated and/or before or after the forming has been terminated.

The following text and figures illustrate and discuss some of the effects of passing an electrical current through a metallic component while it is being formed.

Figure 1:
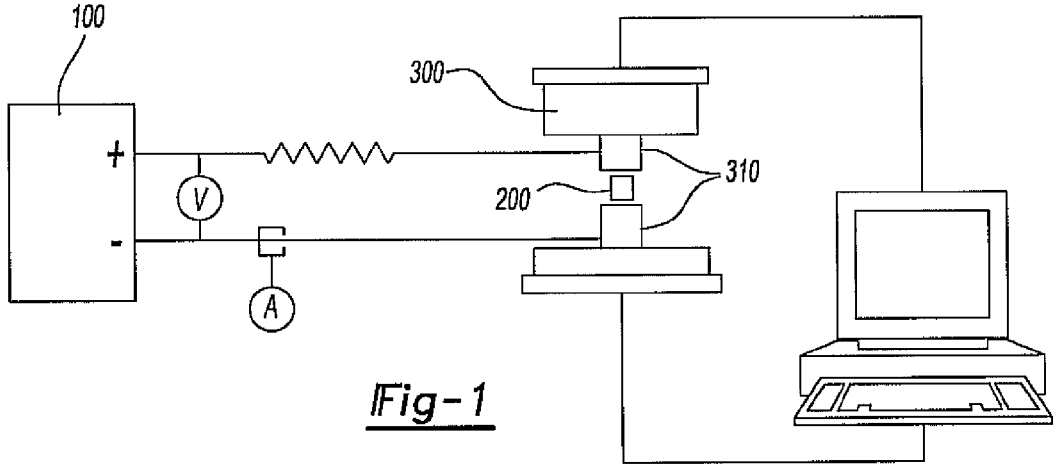
FIG. 1 is a schematic illustration of an apparatus used to cold work a metallic component while an electric current is passed through the component.

Turning to FIG. 1, a schematic representation of an apparatus used to form and apply an electrical direct current to a metal component is shown. The electric current is provided by a direct current (DC) source 100 and deformation to a metal specimen 200 is provided by a compression source 300.

The metal specimen 200 is placed between mounts 310 which are electrically connected to the DC source 100. Upon initiation of the process, the compression source 300 is activated and a compressive force is applied to the specimen 200. While the specimen is under compression, an electrical direct current from the DC source 100 is passed through the mounts 310 and the specimen 200.

Figure 2:
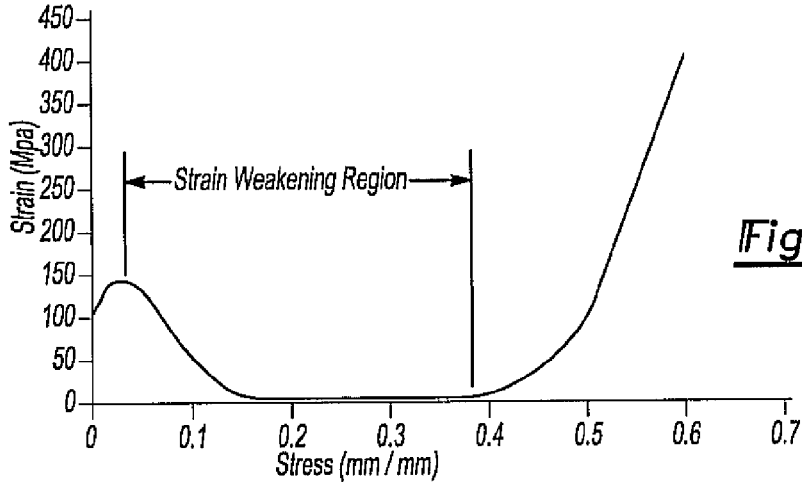
FIG. 2 is a graph illustrating the typical strain versus stress for metallic components undergoing strain weakening during compressive deformation when deformed under an applied current.

Turning to FIG. 2, a schematic representation of the stress as a function of compressive strain for the metallic specimen 200 is shown wherein a decrease in the stress required for continued strain is illustrated and afforded by passing the electric current through the specimen. This phenomena is hereby referred to as strain weakening and has been shown to be well in excess of that which can be explained through thermal softening. In this manner, an apparatus and method for the strain weakening of a material while undergoing compressive deformation is provided.

In order to better illustrate the invention and yet in no way limit its scope, examples of the apparatus and method are provided below.

EXAMPLES

Testing Parameters and Setup

A Tinius Olsen Super "L" universal testing machine was used as a cold forming machine and electrical direct current was generated by a Lincoln Electric R35 arc welder with variable voltage output. In addition, a variable resistor was used to control the magnitude of electric current flow. The testing fixtures used to compress metallic specimens were comprised of hardened steel mounts and Haysite reinforced polyester with PVC tubing. The polyester and PVC tubing were used to isolate the testing machine and fixtures from the electric current.

The current for a test was measured using an Omega® HHM592D digital clamp-on ammeter, which was attached to one of the leads from the DC source 100 to one of the testing fixtures 310. The current level was recorded throughout the test. A desktop computer using Tinius Olsen Navigator software was used to measure and control the testing machine. The Navigator software recorded force and position data, which later, in conjunction with MATLAB® software and fixture compliance, allowed the creation of stress-strain plots for the metallic material. The temperature of the specimens was determined during the test utilizing two methods. The first method was the use of a thermocouple and the second method was the use of thermal imaging.

The test specimens consisted of two different sizes. A first size was a 6.35 millimeter (mm) diameter rod with a 9.525 mm length. The second size was a 9.525 mm diameter rod with a 12.7 mm length. The approximate tolerance of the specimen dimensions was +0.25 mm. After measuring the physical dimensions of a specimen 200 in order to account for inconsistency in manufacturing, the specimen 200 was inserted into the fixtures 310 of the compression device 300 and preloaded to 222 newtons (N) before the testing began. The preload was applied to ensure that the specimen had good contact with the fixtures 310, thereby preventing electrical arcing and assuring accurate compression test results. The tests were performed at a loading rate, also known as a fixture movement rate, of 25.4 mm per minute (mm/min) and the tests were run until the specimen fractured or the load reached the maximum compressive limit of 244.65 kN set for the fixtures, whichever was reached first.

The initial temperature of the specimen 200 was measured using a thermocouple and the welder/variable resistor settings were also recorded. Baseline tests were performed without electric current passing through the specimen using the same fixtures and setup as the tests with electric current. Once the specimens were preloaded to 222 N, and all of the above mentioned measurements obtained, a thermal imaging camera used for thermal imaging was activated and recorded the entire process (the specimens were coated black with high temperature ceramic paint to stabilize the specimen's emissivity). During a given test, current and thermocouple temperature measurements were also recorded by hand.

The electricity was not applied to the specimens until the force on the specimen reached 13.34 kN unless otherwise noted. It was found that the amount of strain at which time the electric current was applied affected the specimen's compression behavior and the shape of the respective stress-strain curve. After each of the tests concluded, final temperature measurements were made using the thermocouple. After cooling, the specimen was removed and a final deformation measurement taken.

A precaution was taken to ensure the accuracy of the results by testing the samples for Ohmic behavior. When metals are exposed to high electric currents, they can display non-Ohmic behavior, which can significantly change their material properties. Therefore, tests were conducted with high current densities to ensure that the metallic material tested was still within its Ohmic range. This was accomplished by applying increased current densities to a specimen, and measuring the corresponding current and voltage. Using the measured resistivity of the metallic materials, it was verified that the materials behaved Ohmically, that is the Ohm's Law relationship was obeyed.

Testing Results

Figure 3:
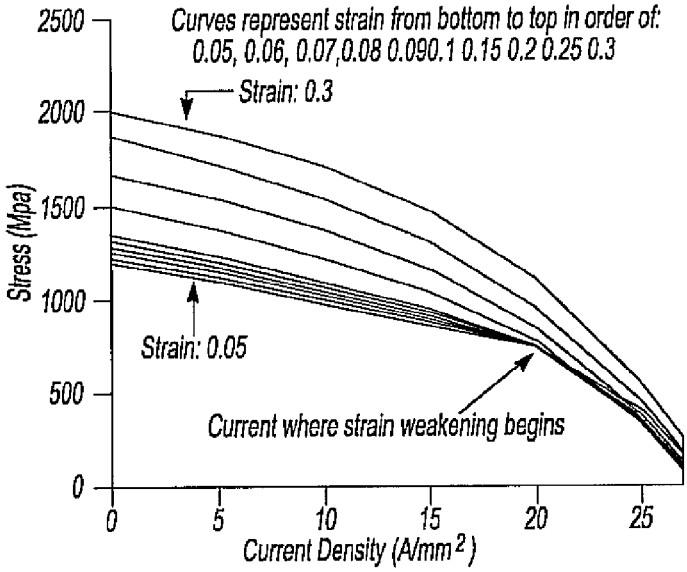
FIG. 3 is a graph of stress versus current density for 6Al-4V titanium alloy specimens subjected to different strain during compression testing wherein an inflection point illustrates where strain weakening begins for the alloy.

Initially, tests were conducted in order to find the current density needed to cause strain weakening behavior to occur with 6Al-4V titanium. This density was determined by plotting the decrease in strength for the material with an increase in current density. As shown in FIG. 3, wherein each line represents a constant strain, the stress required to obtain a particular strain as a function of current density was plotted. The graph shows the degree to which the strength of the material decreases as the current density increases. In addition, the point where strain weakening begins is the inflection point noted on the graph and shown by the arrow. It is appreciated that this method can be used to estimate the current density at which other metallic materials will exhibit strain weakening.

Figure 4:
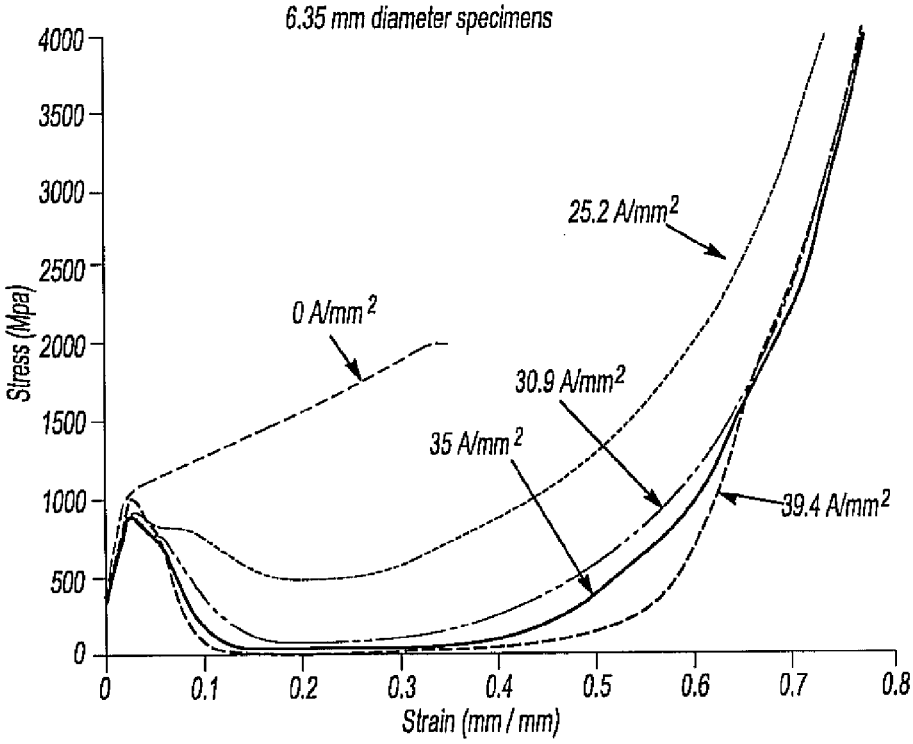
FIG. 4 is a graph of stress versus strain for compression testing of 6.35 mm diameter 6Al-4V titanium alloy specimens with each specimen subjected to a different current density during the testing.
Figure 5:
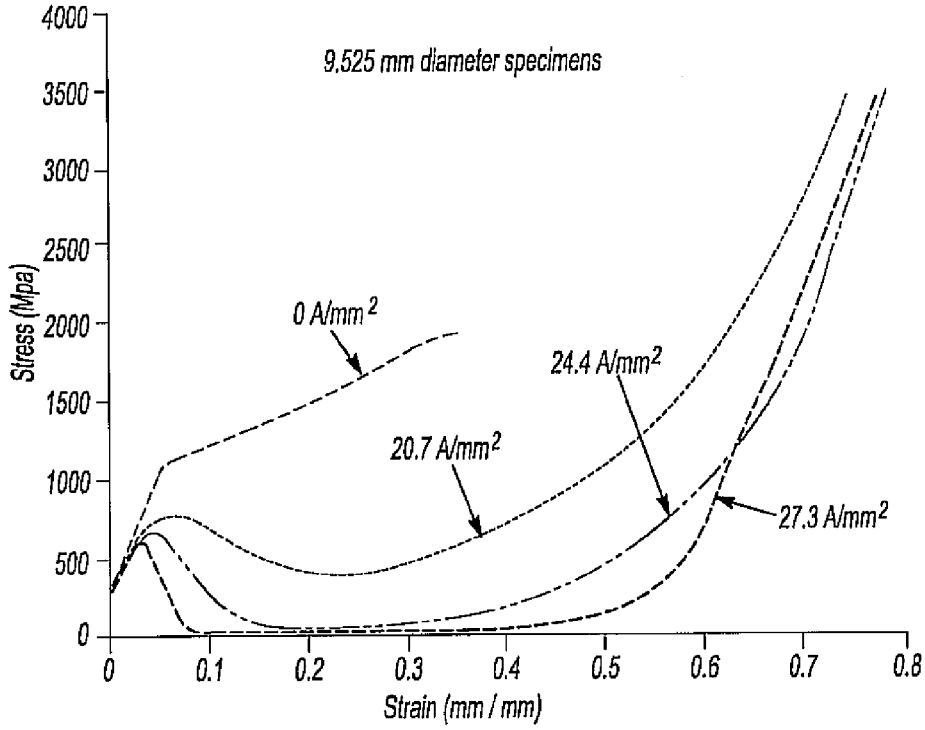
FIG. 5 is a graph of stress versus strain for compression testing of 9.525 mm diameter 6Al-4V titanium alloy specimens with each specimen subjected to a different current density during the testing.

Turning to FIG. 4, strain weakening exhibited by 6Al-4V titanium is shown. Starting with a current density of approximately 25 amps per square millimeter ($A/mm^2$) and performing tests with higher current densities, a decrease in stress for continued increase in strain was observed at yield points of approximately 0.04 mm/mm strain for 6.35 mm diameter specimens. A comparative test run with no electric current is also shown in the figure for comparison. Thus the unique phenomena of obtaining further deformation of a metallic material with a decrease in stress is shown in this plot, where the baseline material fractured between 0.3 and 0.4 strain, while the specimens deformed under the applied current never fractured. Furthermore, it is seen that the higher the current density, the earlier the material yields and the more the overall ductility or strain at fracture increases. This decrease in force for continued deformation of the material is well suited for forming parts and components. Similar results are shown in FIG. 5 wherein specimens having a diameter of 9.525 mm were tested.

Figure 6:
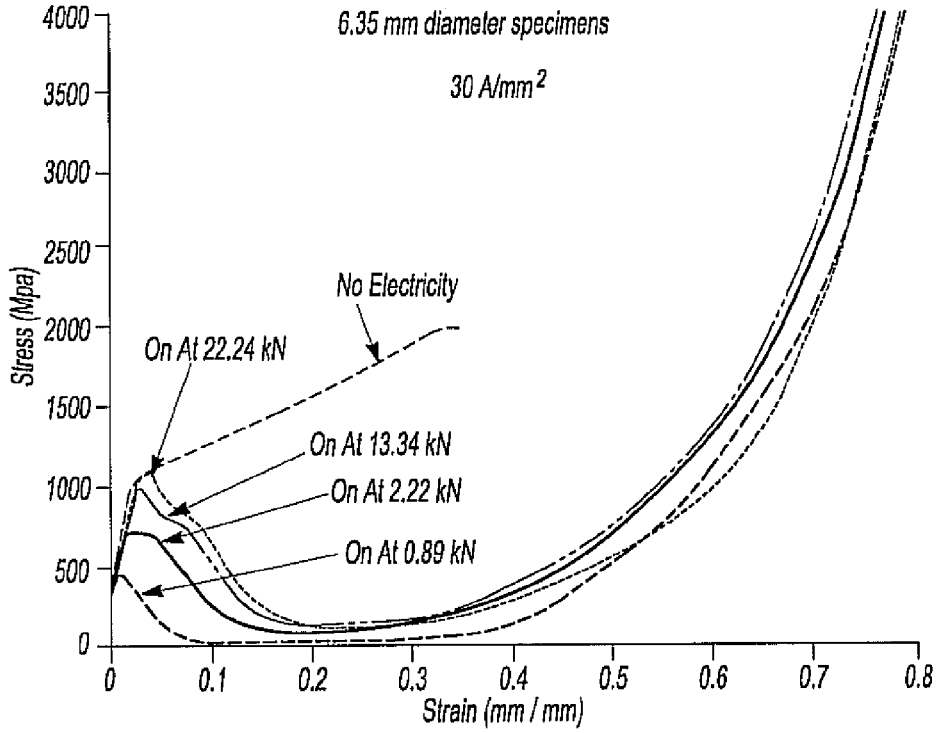
FIG. 6 is a graph of stress versus strain for compression testing of 6.35 mm diameter 6Al-4V titanium alloy specimens subjected to a current density of 30 A/mm$^2$, the electric current having been initiated at different times for each specimen.
Figure 7:
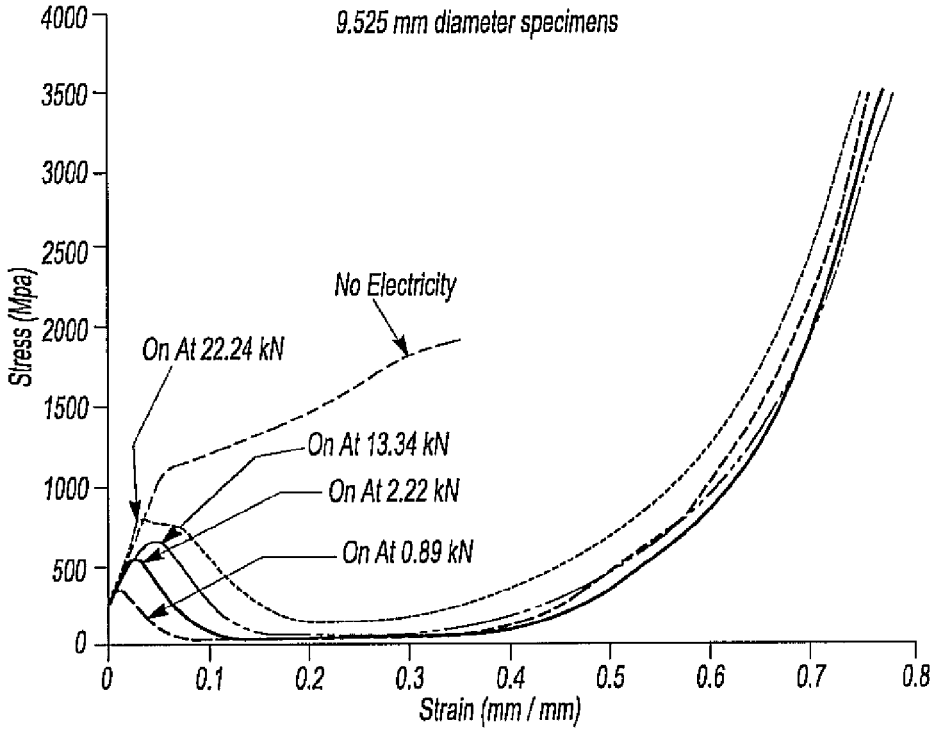
FIG. 7 is a graph of stress versus strain for compression testing of 9.525 mm diameter 6Al-4V titanium alloy specimens subjected to a current density of 23.2 A/mm$^2$, the electric current having been initiated at different times for each specimen.

The effect of initiating the electric current at different times or strains during the compression test is illustrated in FIG. 6 for 6.35 mm diameter specimens and FIG. 7 for 9.525 mm diameter specimens. A current density of 30 $A/mm^2$ was used for the 6.35 mm diameter specimens and 23.2 $A/mm^2$ for the 9.525 mm diameter specimens. As shown in FIG. 6, specimens where the electric current was initiated at 0.89 kN, 2.22 kN, 13.34 kN and 22.24 kN during the compression testing exhibited behavior that was a function of when the electric current started. For example, the sooner the electric current was applied to the specimen, the lower the yield point of the material. In addition, the sooner the electric current was initiated, the greater the amount of strain weakening exhibited by a particular specimen. The same is true for the 9.525 mm diameter specimens as illustrated in FIG. 7.

It is appreciated that some of these effects can be contributed to temperature, since the sooner the electric current was initiated, the faster and hotter a specimen became. However, it has been established that the effect of an applied current during deformation is greater than can be explained through the corresponding rise in workpiece temperature. It is further appreciated that the amount of work hardening imposed on the specimen can vary as a function of the time load when the electric current is initiated.

Figure 8:
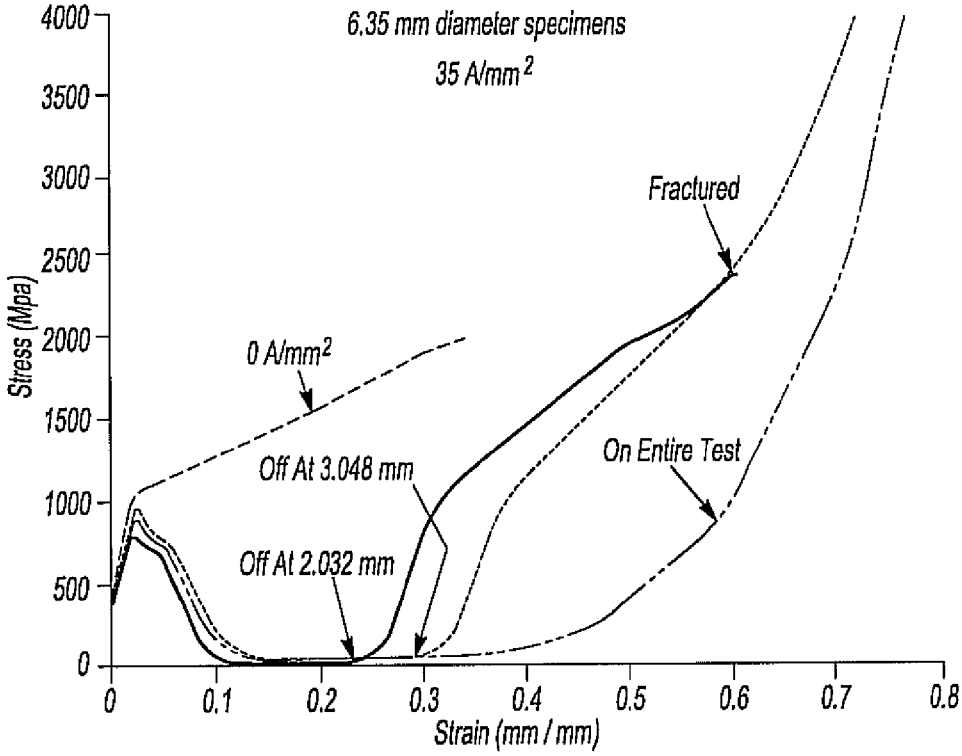
FIG. 8 is a graph of stress versus strain for compression testing of 6.35 mm diameter 6Al-4V titanium alloy specimens subjected to a current density of 35 A/mm$^2$, the electric current having been terminated at different times for each specimen.

The effect of removing the electric current during the testing process was also evaluated. Turning to FIG. 8, a plot of 6.35 mm diameter specimens compression tested with no electricity and with electricity applied during the entire test is shown for comparison. In addition, the two plots wherein the electric current was terminated at a total deformation of 2.032 mm and 3.048 mm are shown. For the 9.525 mm diameter specimens, the electric current was terminated at a total strain of 3.048 mm and 4.064 mm (see FIG. 9). These figures illustrate that the sooner the electric current is terminated the sooner the specimens stop exhibiting strain weakening behavior. In addition, when the electric current is terminated the slope of the stress versus strain curve is steeper than if the electric current is applied to a specimen for the entire test. Furthermore, when the electricity was discontinued early in the test, the material once again was found to fracture.

Figure 9:
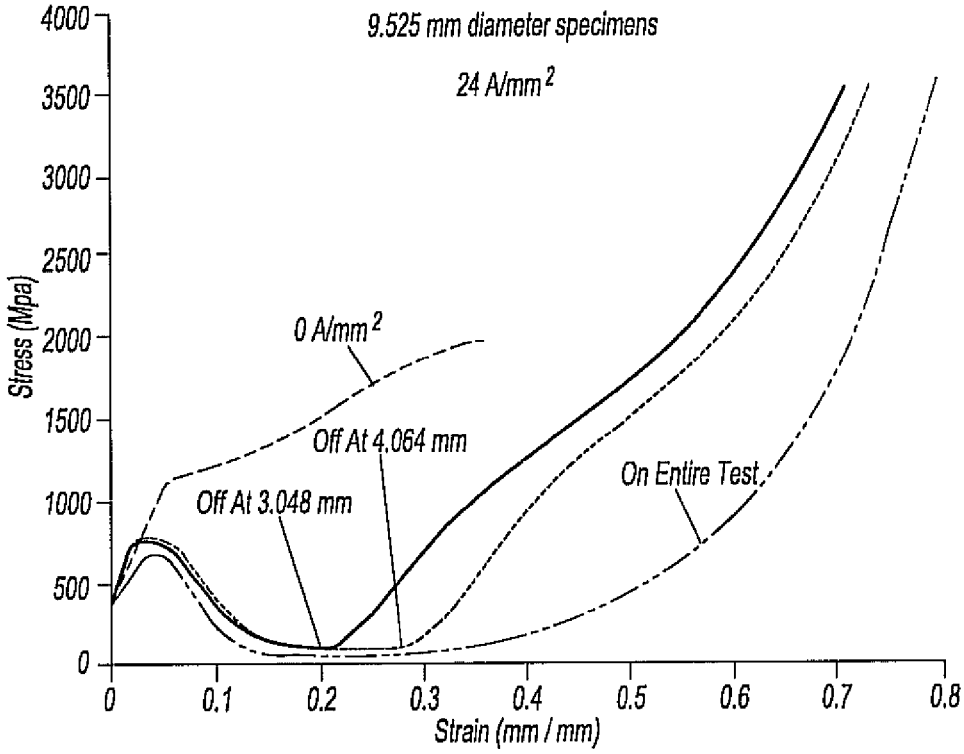
FIG. 9 is a graph of stress versus strain for compression testing of 9.525 mm diameter 6Al-4V titanium alloy specimens subjected to a current density of 24 A/mm$^2$, the electric current having been terminated at different times for each specimen.

It is appreciated that the effects of initiating and/or terminating the electric current at different points along a compression/deformation process can be used to enhance the microstructure and/or properties of materials, components, articles, etc. subjected to deformation processes. For example, in some instances, a certain amount of work hardening within a metal component would be desirable before the onset of the strain weakening were to be imposed. In such instances, FIGS. 6 and 7 illustrate that work hardening could be imposed on a component by initiating the electric current through the workpiece after plastic deformation has begun. In other instances, a certain amount of work hardening imposed on a workpiece after or towards the end of the deformation process could be desirable. As such, FIGS. 8 and 9 illustrate how the termination of the electric current passing through the component at different times or strains of the deformation process result in different amounts of work hardening in the sample. In this manner, physical and/or mechanical properties, illustratively including strength, percentage of cold work, hardness, ductility, rate of recrystallization and the like, of a formed component can be manipulated.

Figure 10:
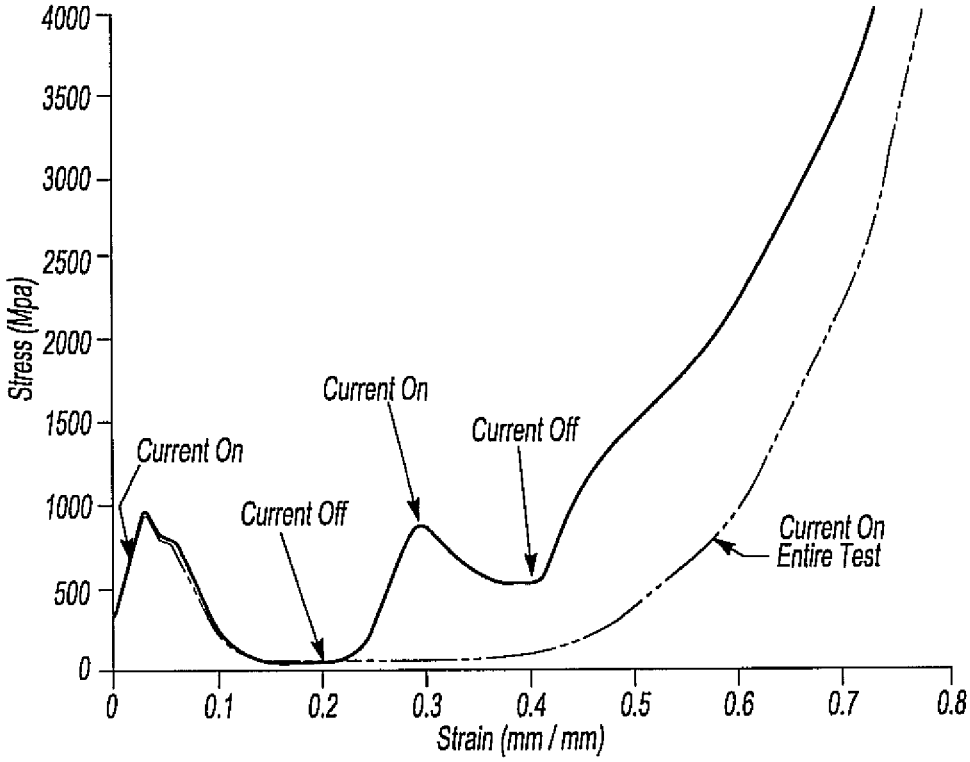
FIG. 10 is a graph of stress versus strain for compression testing of a 6.35 mm diameter 6Al-4V titanium alloy specimen subjected to a current density of 35 A/mm$^2$, the electric current having been cycled on and off during the test.

Turning now to FIG. 10, the effect of the electric current on the enhanced forgeability of 6AL-4V titanium was demonstrated by passing a current density of 35 A/mm$^2$ through the sample and cycling the current during the test. The electricity was initiated at a force of 13.34 kN and then cycled on and off approximately every 1 mm of deformation up to a total of 4 mm, at which point the electricity remained off until the test was completed. As indicated in the figure, it is visible that the electric current was terminated at approximately 0.225 mm/mm and then reapplied at 0.290 mm/mm. In addition, it is apparent that when the electric current was terminated, the sample exhibited work hardening stress-strain behavior evidenced by an increase in stress for continued plastic deformation. As such, cycling the electric current during compression forming can also afford for the control and manipulation of a components physical and/or mechanical properties.

Figure 11:
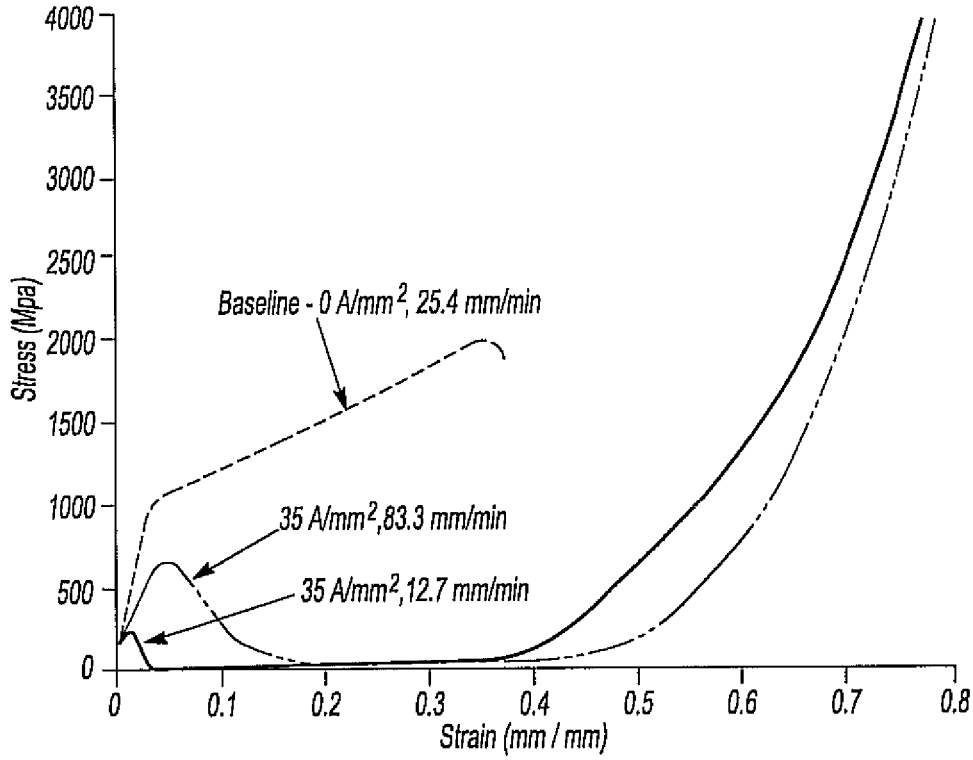
FIG. 11 is a graph of stress versus strain for compression testing of two 6.35 mm diameter 6Al-4V titanium alloy specimens subjected to a current density of 35 A/mm$^2$ and each specimen compressed with a different strain rate.

The effect of varying the strain rate during compression testing is shown in FIG. 11, with a 6.35 mm diameter specimen tested at platen speeds of 12.7 and 83.3 mm/min. The electric current was applied to the specimens at a load of 4.45 kN and remained on during the entire test. As illustrated in FIG. 11, the approximate amount of time the sample exhibits strain weakening is equivalent for both strain rates, however the initiation of strain weakening occurred sooner for the lower strain rate while the end of strain weakening behavior occurred later for the higher strain rate. As such, the amount of work hardening produced in a component before strain weakening occurs can be further manipulated by the strain rate.

Figure 12:
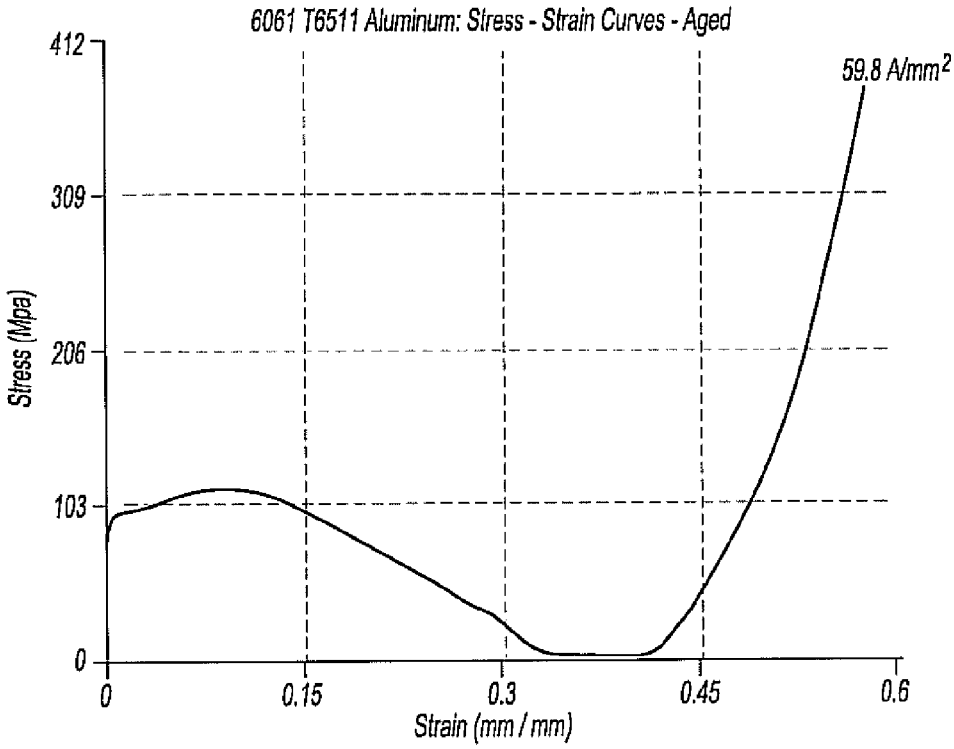
FIG. 12 is a graph of stress versus strain for compression testing of a 6.35 mm diameter 6061 T6511 aluminum alloy specimen subjected to a current density of 59.8 A/n=mm$^2$ during compression testing.
Figure 13:
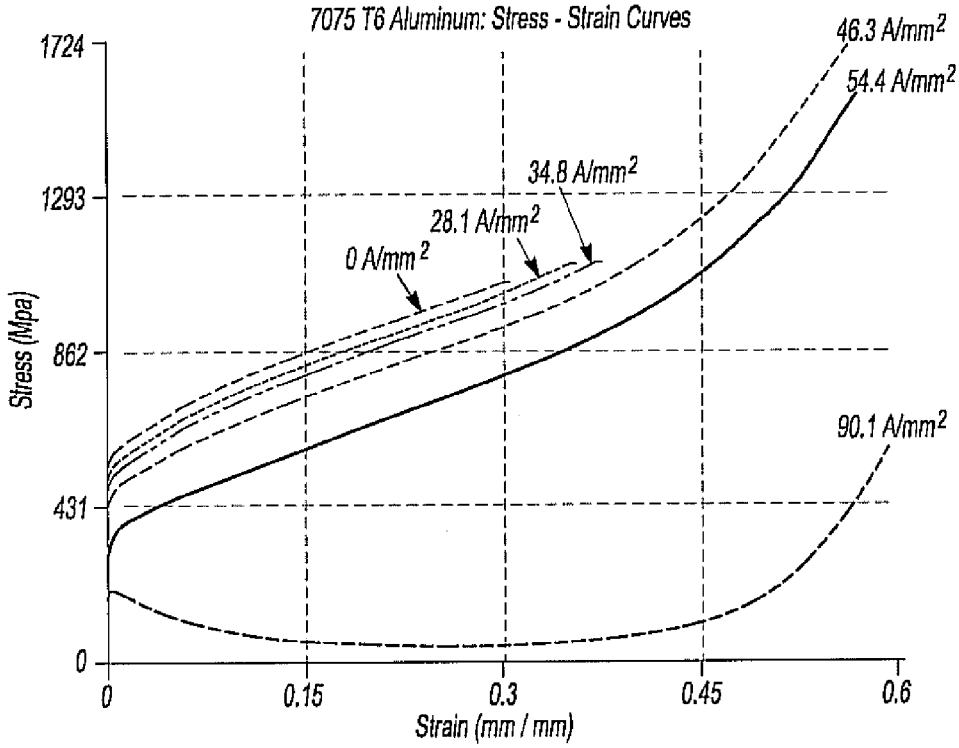
FIG. 13 is a graph of stress versus strain for compression testing of 6.35 mm diameter 7075 T6 aluminum alloy specimens with each specimen subjected to a different current density during the testing.
Figure 14:
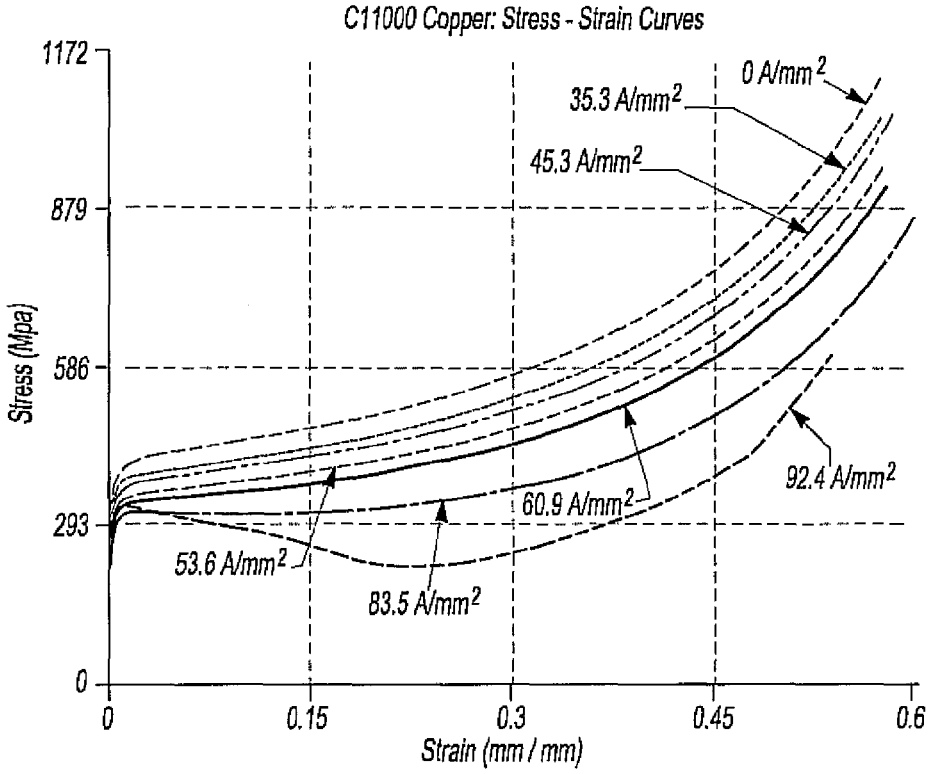
FIG. 14 is a graph of stress versus strain for compression testing of 6.35 mm diameter C11000 copper alloy specimens with each specimen subjected to a different current density during the testing.
Figure 15:
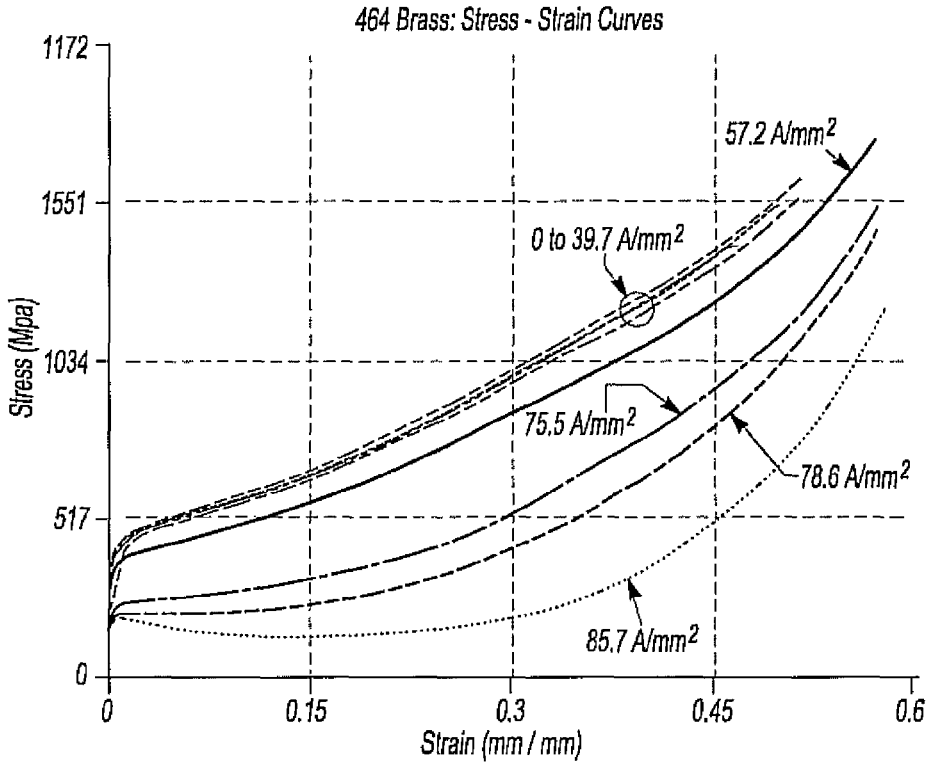
FIG. 15 is a graph of stress versus strain for compression testing of 6.35 mm diameter 464 brass alloy specimens with each specimen subjected to a different current density during the testing.

Strain weakening behavior via electric current has been demonstrated by other alloys as illustrated in FIGS. 12-16. For example, FIG. 12 shows a stress-strain curve wherein a 6061 T6511 aluminum specimen underwent compression testing with a current density of 59.8 A/mm$^2$ applied thereto. As shown in this figure, at a strain of approximately 0.10 mm/mm a decrease in stress was required for additional deformation to occur. Likewise, FIGS. 13-15 illustrate similar strain weakening behavior for 7075 T6 aluminum with a 90.1 A/mm$^2$ current density applied thereto, C11000 copper (92.4 A/mm$^2$) and 464 brass (85.7 A/mm$^2$).

Figure 16:
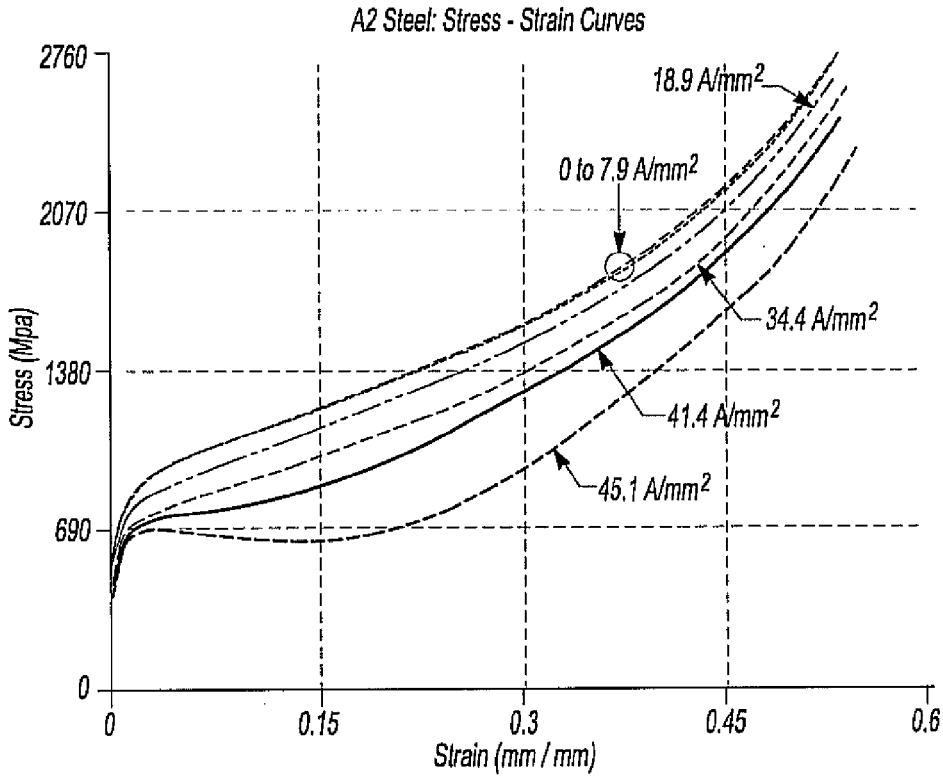
FIG. 16 is a graph of stress versus strain for compression testing of 6.35 mm diameter A2 steel specimens with each specimen subjected to a different current density during the testing.

The inducement of strain weakening using the current method of the present invention can also be applied to ferrous alloys. FIG. 16 illustrates an M tool steel which has been subjected to a number of different current densities while undergoing compression testing. As shown in this figure, at a current density of 45.1 A/mm$^2$, the A2 tool steel exhibited a decrease in stress required for an increase in strain after a yield point at approximately 0.02 mm/mm. Thus it is apparent that the method wherein electric current is used to induce strain weakening and control/manipulate physical and/or mechanical properties can be applied to a variety of metallic materials.

Figure 18:
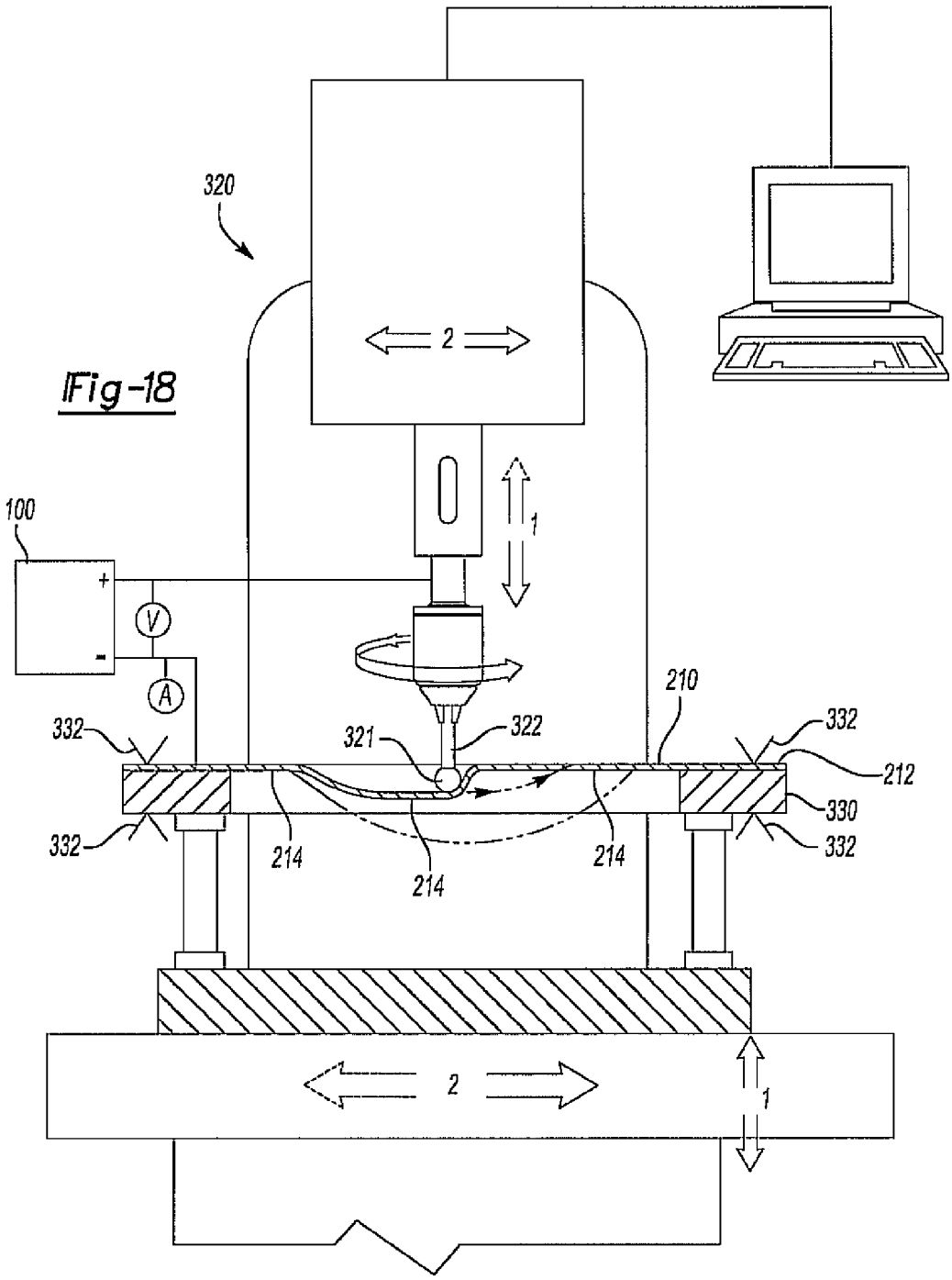
FIG. 18 is an illustration of an apparatus used to cold work a metallic component according to an embodiment of the present invention.

Turning now to FIGS. 18 and 19, an embodiment of the present is shown. The embodiment includes providing a single point incremental forming (SPIF) machine 320 having a arcuate tipped tool 322. For the purposes of the present invention the term "arcuate tipped tool" includes any tool with a curved shaped tip, illustratively including tools with a round shaped tip, spherical shaped tip and the like. The forming machine has a support structure 330 onto which a piece of sheet metal 210 can be placed. In some instances, the support structure 330 has a clamping structure 332 that can rigidly hold an outer perimeter 212 of the piece of sheet metal 210 and leave a portion 214 of the sheet metal 210 unsupported. In addition, the arcuate tipped tool 322 may or may not have a spherical shaped head 321 with a shaft 323 extending therefrom.

Also included with the forming machine 320 is the electrical current source 100 that is operable to pass electrical direct current through the piece of sheet metal 210. In some instances, the electrical direct current passes through the arcuate tipped tool 322 to the piece of sheet metal 210. In fact, the electrical current can pass down through the arcuate tipped tool 322, pass through a minimal amount of the sheet metal 210 where deformation is occurring and then exit the sheet metal through a probe (not shown) that is offset from the tool. In this manner, the entire workpiece does not have to be energized, i.e. have electrical current passing through it. It is appreciated that the single point incremental forming and/or electrical current can be applied to the sheet metal 210 during cold, warm and hot forming operations.

The forming machine 320 can be a computer numerical controlled machine that can move the arcuate tipped tool 322 a predetermined distance in a predetermined direction. For example, the forming machine 320 can move the arcuate tipped tool 322 in a generally vertical (e.g. up and down) direction 1 and/or a generally lateral (e.g. side to side) direction 2. In the alternative, the support structure 330 can move the piece of sheet metal 210 in the generally vertical direction 1 and/or the generally lateral direction 2 relative to the arcuate tipped tool 322. The arcuate tipped tool 322 can be rotationally fixed, free to rotate and/or be forced to rotate. After the piece of sheet metal 210 has been attached to the support structure 330, the arcuate tipped tool 322 comes into contact with and makes a plurality of single point incremental deformations on the piece of sheet metal 210 and affords for a desirable shape to be made therewith.

During at least part of the time when the arcuate tipped tool 322 is producing the plurality of single point incremental deformations on the piece of sheet metal 210, the electrical direct current can be made to pass through the piece of sheet metal. It is appreciated that in accordance with the above teaching regarding passing electrical direct current through a metal workpiece, that the force required to plastically deform the piece of sheet metal is reduced. In addition, it is appreciated that the amount of plastic deformation exhibited by the piece of sheet metal before failure occurs can be increased by passing the electrical direct current therethrough.

It is further appreciated that the amount of springback exhibited by the plastic deformation of the piece of sheet metal is reduced by the electrical direct current. In some instances, the amount of springback is reduced by 50%, while in other instances the amount of springback is reduced by 60%. In still other instances, the amount of springback can be reduced by 70%, 80%, 90% or in the alternative greater than 95%. The arcuate tipped tool may be rotationally fixed, freely rotating or forced to rotate. In addition, this method provides for a die-less fabrication technique ideally suited for the manufacture of prototype parts and small batch jobs with FIGS. 20 and 21 illustrating example shapes made using an embodiment of the present invention.

The foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

I claim:

1. A method for forming a piece of sheet metal while passing an electrical direct current through at least part of the piece of sheet metal, the method comprising:

providing a piece of sheet metal to be formed;

providing a computer numerical controlled machine, the machine having an arcuate tipped tool and being operable to move the arcuate tipped tool a predetermined distance in a predetermined direction and producing a single point incremental deformation to the piece of sheet metal;

providing a support structure dimensioned to rigidly hold at least part of the piece of sheet metal;

attaching the piece of sheet metal to the support structure;

providing an electric current source operable to pass electrical direct current through at least part of the piece of sheet metal;

forming the piece of sheet metal with a plurality of single point incremental deformations by the arcuate tipped tool; and passing the electrical direct current through the arcuate tipped tool into the piece of sheet metal locally and during at least part of the time the piece of sheet metal is being formed by the arcuate tipped tool.

2. The method of claim 1, wherein the current is applied after the forming has started.

3. The method of claim 1, wherein the current is terminated before the forming has been terminated.

4. The method of claim 1, wherein the current is cycled during the forming.

5. The method of claim 1, wherein a current density of the current is increased during the forming.

6. The method of claim 1, wherein a current density of the current is decreased during the forming.

7. The method of claim 1, wherein the sheet metal component is made from a material selected from the group consisting of iron, aluminum, titanium, copper and alloys thereof.

8. The method of claim 1, wherein the arcuate tipped tool has a spherical shaped head.

9. The method of claim 1, wherein passing the electrical direct current through the metal component during at least part of the time the metal component is being formed reduces the amount of springback by the piece of formed sheet metal.

10. A method for die-less forming a piece of sheet metal while passing an electrical direct current through the piece of sheet metal, the method comprising:

providing a piece of sheet metal to be formed;

providing a computer numerical controlled machine, the machine having an arcuate tipped tool and being operable to move the arcuate tipped tool a plurality of predetermined distances in a plurality of predetermined directions and produce a plurality of single point incremental deformations to the piece of sheet metal;

providing a support structure having a clamping structure, the clamping structure operable to rigidly hold an outer perimeter of the piece of sheet metal and leave a portion of the sheet metal unsupported;

attaching the piece of sheet metal to the support structure using the clamping structure;

providing an electric current source operable to pass electrical direct current through the arcuate tipped tool to piece of sheet metal;

forming the sheet metal component with the plurality of single point incremental deformations by the arcuate tipped tool moving in the plurality of predetermined distances in the plurality if predetermined directions; and passing the electrical direct current through the arcuate tipped tool into the piece of sheet metal locally and during at least part of the time the piece of sheet metal is being formed.

11. The method of claim 10, wherein the arcuate tipped tool has a spherical shaped head.

12. The method of claim 10, wherein the current is applied after the forming has started.

13. The method of claim 10, wherein the current is terminated before the forming has stopped.

14. The method of claim 10, wherein the current is cycled during the forming.

15. The method of claim 10, wherein a current density of the current is increased during the forming.

16. The method of claim 10, wherein a current density of the current is decreased during the forming.

17. The method of claim 10, wherein passing the electrical direct current through the metal component during at least part of the time the metal component is being formed reduces the amount of springback by the piece of formed sheet metal.

* * * * *

UNITED STATES PATENT AND TRADEMARK OFFICE

CERTIFICATE OF CORRECTION

PATENT NO. : 8,021,501 B2
APPLICATION NO. : 12/194355
DATED : September 20, 2011
INVENTOR(S) : John Roth It is certified that error appears in the above-identified patent and that said Letters Patent is hereby corrected as shown below:

Column 2, line 8 - delete "AlMgI-SiCu" and insert --AlMgl-SiCu--

Column 9, line 52 - delete "M" and insert --A2--

Signed and Sealed this
Seventeenth Day of April, 2012

David J. Kappos

David J. Kappos
*Director of the United States Patent and Trademark Office*